US011414965B2

(12) United States Patent
Zhao et al.

(10) Patent No.: US 11,414,965 B2
(45) Date of Patent: Aug. 16, 2022

(54) ROTATING LOADING TUBE AND ANGLED SHAPED CHARGES FOR ORIENTED PERFORATING

(71) Applicant: Schlumberger Technology Corporation, Sugar Land, TX (US)

(72) Inventors: Haifeng Zhao, Sugar Land, TX (US); Luis Rodolfo Medina Pacheco, Pearland, TX (US); Bennie Gill, Fulshear, TX (US); Wayne Nivens, Richmond, TX (US); Jock Munro, Bucharest (RO)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/222,095

(22) Filed: Dec. 17, 2018

(65) Prior Publication Data

US 2019/0264548 A1 Aug. 29, 2019

Related U.S. Application Data

(60) Provisional application No. 62/747,723, filed on Oct. 19, 2018, provisional application No. 62/635,765, filed on Feb. 27, 2018.

(51) Int. Cl.
*E21B 43/119* (2006.01)
*E21B 43/118* (2006.01)
(Continued)

(52) U.S. Cl.
CPC ..... *E21B 43/119* (2013.01); *E21B 17/1057* (2013.01); *E21B 43/117* (2013.01); *E21B 43/118* (2013.01)

(58) Field of Classification Search
CPC .. E21B 17/1057; E21B 43/117; E21B 43/118; E21B 43/119
See application file for complete search history.

(56) References Cited

U.S. PATENT DOCUMENTS 1,987,316 A 1/1935 Zimmer
2,500,359 A 3/1950 Jewett
(Continued)

FOREIGN PATENT DOCUMENTS

EP 0452126 A2 10/1991
GB 2128719 A 5/1984
(Continued)

OTHER PUBLICATIONS

International Search Report and Written Opinion issued in the related PCT Application PCT/US2019/019776, dated Jun. 7, 2019 (12 pages).
(Continued)

*Primary Examiner* — Caroline N Butcher
(74) *Attorney, Agent, or Firm* — Rodney Warrford

(57) ABSTRACT

Described herein is a perforating assembly and method of use. In one embodiment, the perforating assembly comprising an offset loading tube mounted within a gun carrier. A plurality of shaped charges are mounted within the loading tube and the loading tube is mounted within the gun carrier on one or more swivel mechanisms that enable the loading tube to rotate within the gun carrier.

17 Claims, 10 Drawing Sheets

(51) Int. Cl.
*E21B 43/117* (2006.01)
*E21B 17/10* (2006.01)

(56) References Cited

U.S. PATENT DOCUMENTS

| | | | | |
|---|---|---|---|---|
| 3,014,542 | A | 12/1961 | Hildebrandt | |
| 3,089,416 | A | 5/1963 | Gilbert | |
| 3,145,787 | A | 8/1964 | Brown | |
| 4,153,118 | A | 5/1979 | Hart | |
| 4,410,051 | A | 10/1983 | Daniel et al. | |
| 4,438,810 | A | 3/1984 | Wilkinson | |
| 4,523,649 | A | 6/1985 | Stout | |
| 4,613,002 | A | 9/1986 | Pittman et al. | |
| 4,637,478 | A | 1/1987 | George | |
| 4,919,205 | A * | 4/1990 | Dollison | E21B 17/1057 166/241.3 |
| 5,010,964 | A | 4/1991 | Cornette | |
| 5,040,619 | A | 8/1991 | Jordan et al. | |
| 5,163,721 | A | 11/1992 | Babuder | |
| 5,176,406 | A | 1/1993 | Straghan | |
| 5,211,714 | A | 5/1993 | Jordan et al. | |
| 5,259,466 | A | 11/1993 | Venditto et al. | |
| 5,273,121 | A | 12/1993 | Kitney et al. | |
| 5,285,683 | A | 2/1994 | Abass et al. | |
| 5,318,123 | A | 6/1994 | Venditto et al. | |
| 5,335,724 | A | 8/1994 | Venditto et al. | |
| 5,366,014 | A | 11/1994 | George | |
| 5,394,941 | A | 3/1995 | Venditto et al. | |
| 5,603,379 | A | 2/1997 | Henke et al. | |
| 5,778,979 | A | 7/1998 | Burleson et al. | |
| 5,964,294 | A | 10/1999 | Edwards et al. | |
| 6,003,599 | A | 12/1999 | Huber et al. | |
| 6,173,773 | B1 | 1/2001 | Almaguer et al. | |
| 6,230,825 | B1 | 5/2001 | Aumann et al. | |
| 6,378,607 | B1 | 4/2002 | Ryan et al. | |
| 6,591,911 | B1 | 7/2003 | Markel et al. | |
| 6,595,290 | B2 | 7/2003 | George et al. | |
| 6,679,327 | B2 | 1/2004 | Sloan et al. | |
| 7,000,699 | B2 | 2/2006 | Yang et al. | |
| 7,013,977 | B2 | 3/2006 | Nordaas | |
| 7,114,564 | B2 | 10/2006 | Parrott et al. | |
| 8,002,035 | B2 | 8/2011 | Hales et al. | |
| 8,066,083 | B2 | 11/2011 | Hales et al. | |
| 8,181,718 | B2 | 5/2012 | Burleson et al. | |
| 8,439,114 | B2 | 5/2013 | Parrott et al. | |
| 8,443,886 | B2 | 5/2013 | Torres et al. | |
| 2003/0098158 | A1 * | 5/2003 | George | E21B 43/119 166/297 |
| 2003/0188867 | A1 * | 10/2003 | Parrott | E21B 47/024 166/297 |
| 2005/0092493 | A1 | 5/2005 | Sukup et al. | |
| 2007/0175637 | A1 | 8/2007 | Leising et al. | |
| 2009/0242198 | A1 * | 10/2009 | Evans | E21B 43/119 166/250.01 |
| 2015/0226044 | A1 * | 8/2015 | Ursi | E21B 43/119 166/55 |
| 2016/0047205 | A1 * | 2/2016 | Head | E21B 4/006 166/66.4 |

FOREIGN PATENT DOCUMENTS

| | | | |
|---|---|---|---|
| GB | 2329659 | A | 3/1999 |
| GB | 2363449 | A | 12/2001 |
| GB | 2374887 | A | 10/2002 |
| RU | 2059806 | C1 | 5/1996 |
| RU | 2112877 | C1 | 6/1998 |
| RU | 2179235 | C1 | 2/2002 |
| WO | 0075485 | A1 | 12/2000 |

OTHER PUBLICATIONS

International Preliminary Report on Patentability issued in the related PCT Application PCT/US2019/019776, dated Sep. 3, 2020 (8 pages).

Exam Report Under Section 18(3) issued in United Kingdom patent Application GB2013381.5 dated Nov. 29, 2021, 4 pages.

* cited by examiner

Well deviation 40°

Well deviation 60°

ROTATING LOADING TUBE AND ANGLED SHAPED CHARGES FOR ORIENTED PERFORATING

PRIORITY

This application claims the benefit of U.S. Provisional No. 62/635,765, filed Feb. 27, 2018, and U.S. Provisional No. 62/747,723, filed Oct. 19, 2018.

FIELD OF INVENTION

The disclosure relates to the field of hydrocarbon well perforation. More specifically, apparatus and methods of orienting shaped charges and perforating guns are disclosed.

BACKGROUND

When a hydrocarbon well is drilled, a casing may be placed in the well to line and seal the wellbore. Cement is then pumped down the well under pressure and forced up the outside of the casing until the well column is also sealed. This casing process: (a) ensures that the well is isolated, (b) prevents uncontrolled migration of subsurface fluids between different well zones, and (c) provides a conduit for installing production tubing in the well. However, to connect the inside of the casing and wellbore with the inside of the formation to allow for hydrocarbon flow from the formation to the inside of the casing, holes are formed through the casing and into the wellbore. This practice is commonly referred to as perforating of the casing and formation. Open-hole wells are also possible, i.e., where a casing is not used and jetting, fracturing or perforation is directly applied to the formation.

During the perforating process, a gun-assembled body containing a plurality of shaped charges is lowered into the wellbore and positioned opposite the subsurface formation to be perforated. Initiation signals are then passed from a surface location through a wireline to one or more blasting caps located in the gun body, thereby causing detonation of the blasting caps. The exploding blasting caps in turn transfer a detonating wave to a detonator cord which further causes the shaped charges to detonate. The detonated shaped charges form an energetic stream of high-pressure gases and high velocity particles, which perforates the well casing and the adjacent formation to form perforation tunnels. The hydrocarbons and/or other fluids trapped in the formation flow into the tunnels, into the casing through the orifices cut in the casing, and up the casing to the surface for recovery.

Prior to perforating, horizontal or highly deviated wells are studied to determine the most advantageous orientation of perforations. The desired orientation may be selected based on the possibility of sand production, based on the heavy overburden pressure and/or shear stress existing, or based on the location of control lines and/or other downhole equipment and tools.

What is needed is an improved, method and apparatus for the achieving the desired orientation of the shaped charges.

SUMMARY

This summary is provided to introduce a selection of concepts that are further described below in the detailed description. However, many modifications are possible without materially departing from the teachings of this disclosure. Accordingly, such modifications are intended to be included within the scope of this disclosure as defined in the claims. This summary is not intended to identify key or essential features of the claimed subject matter, nor is it intended to be used as an aid in limiting the scope of the claimed subject matter.

An embodiment of the present disclosure provides a perforating assembly, comprising a gun carrier having a longitudinal centerline and a loading tube having a longitudinal centerline mounted within the gun carrier such that the longitudinal centerline of the loading tube is offset from the longitudinal centerline of the loading tube. A plurality of shaped charges are mounted within the loading tube and the loading tube is mounted within the gun carrier on one or more swivel mechanisms that enable the loading tube to rotate within the gun carrier.

Another embodiment of the present disclosure provides a method of orienting a loading tube having a longitudinal centerline within a perforating gun carrier having a longitudinal centerline, the loading tube having shaped charges mounted therein, the method comprising the steps of (a) mounting the loading tube on a swiveling device within the perforating gun carrier, wherein the longitudinal centerline of the loading tube is mounted offset from the longitudinal centerline of the perforating gun carrier, (b) conveying the perforating gun carrier downhole; and (c) rotating the loading tube within the gun carrier.

BRIEF DESCRIPTION OF THE DRAWINGS

Certain embodiments of the disclosure will hereafter be described with reference to the accompanying drawings, wherein like reference numerals denote like elements. It is emphasized that, in accordance with standard practice in the industry, various features are not drawn to scale. In fact, the dimensions of various features may be arbitrarily increased or reduced for clarity of discussion. It should be understood, however, that the accompanying figures illustrate the various implementations described herein and are not meant to limit the scope of various technologies described herein, and.

DETAILED DESCRIPTION

Figure 1:
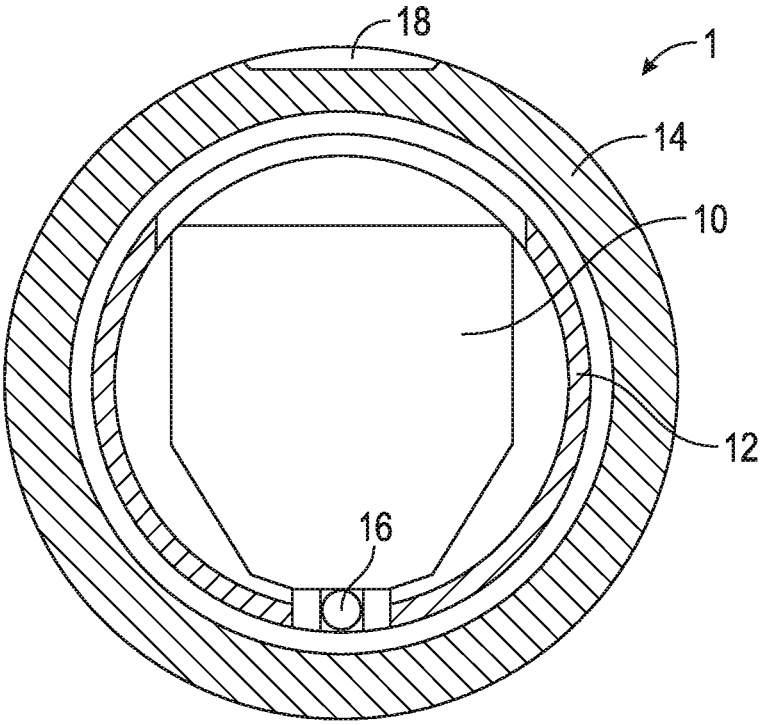
FIG. 1 illustrates a cross section of a perforating gun employed in accordance with various embodiments of the present disclosure.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for purposes of simplicity and clarity and does not in itself dictate a relationship between the various embodiments and/or configurations discussed. However, it will be understood by those of ordinary skill in the art that the system and/or methodology may be practiced without these details and that numerous variations or modifications from the described embodiments are possible. This description is not to be taken in a limiting sense, but rather made merely for purposes of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements.

In this disclosure, unless the context requires otherwise, throughout the specification and claims which follow, the word "comprise" and variations thereof, such as, "comprises" and "comprising" are to be construed in an open, inclusive sense, that is as "including, but not limited to."

In this disclosure, reference to "one embodiment" or "an embodiment" means that a particular feature or features, structures, or characteristics may be combined in any suitable manner in one or more implementations or one or more embodiments.

In this disclosure, the singular forms "a," "an," and "the" include plural referents unless the context clearly dictates otherwise. It should also be noted that the term "or" is generally employed in its broadest sense, that is, as meaning "and/or" unless the content clearly dictates otherwise.

The headings and Abstract of the disclosure provided herein are for convenience only and do not interpret the scope or meaning of the embodiments.

FIG. 1 shows a cross section of a conventional perforating gun. The conventional perforating gun, indicated generally as 1, comprises a shaped charge 10, a loading tube 12, a gun carrier 14, and a detonating cord 16. The illustrated gun 1 also includes a scallop 18 machined out of the gun carrier 14 and aligned with the shaped charge 10. Although the illustrated conventional perforating gun 1 is a scalloped gun 1, it is important to note that the present disclosure is equally applicable to slick-walled guns.

Figure 2:
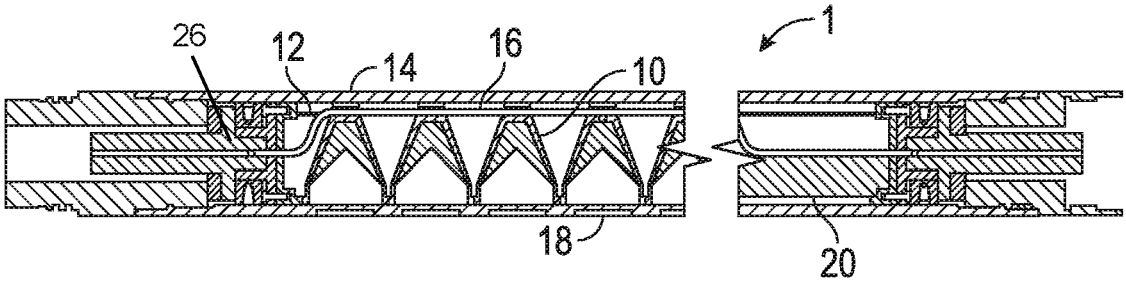
FIG. 2 illustrates a swiveling loading tub, in accordance with various embodiments of the present disclosure.

FIG. 2 illustrates an embodiment of the present disclosure of a perforating gun 1 having the shaped charges 10 mounted in a loading tube 12 that swivels within the gun carrier 14. The loading tube 12 is mounted on a swivel 26 such as a radial bearing that enables the loading tube 12 to freely swivel within the gun carrier 14. In the case of scalloped perforating guns 1, as shown in FIG. 2, the shaped charges 10 must be oriented within the gun carrier 14 such that the shaped charges 10 are aligned with and shoot through the scallops 18. In some embodiments, the loading tube 12 swivels to the correct orientation under its own weight (which includes the weight of the shaped charges 10) into proper alignment with the scallops 18. In other embodiments, the center of gravity of the loading tube 12 may need to be altered through the addition of weights 20 that cause the swiveling loading tube 12 to rotate to the orientation desired (downward in FIG. 2). In the shown example, the weight 20 is a semi-circular weight. However, the weight 20 can be any number of types or configurations such as hollow flask type weights filled with a high-density material, or half solid metal bars, for example. All such modifications remain within the purview of the present disclosure.

In the case of a slick-walled perforating gun 1, no further alignment of the loading tube 12 and shaped charges 10 is necessary as the gun carrier 14 has a uniform thickness around its circumference. Similarly, in the case of a perforating gun 1 having machined grooves extending circumferentially around the gun carrier 14 at the interval of each shaped charge 10, no further loading tube 12 alignment is necessary.

The loading tube 12 in FIG. 2 is shown mounted approximate the longitudinal centerline of the gun carrier 14; however, it should be understood that in alternate embodiments of the present disclosure the loading tube 12 may be mounted within the swivel 26 such that the loading tube 12 is offset from the longitudinal centerline of the gun carrier 14. Such offset embodiments are illustrated with reference to FIG. 12 below and remain within the scope of the present disclosure.

Figure 3:
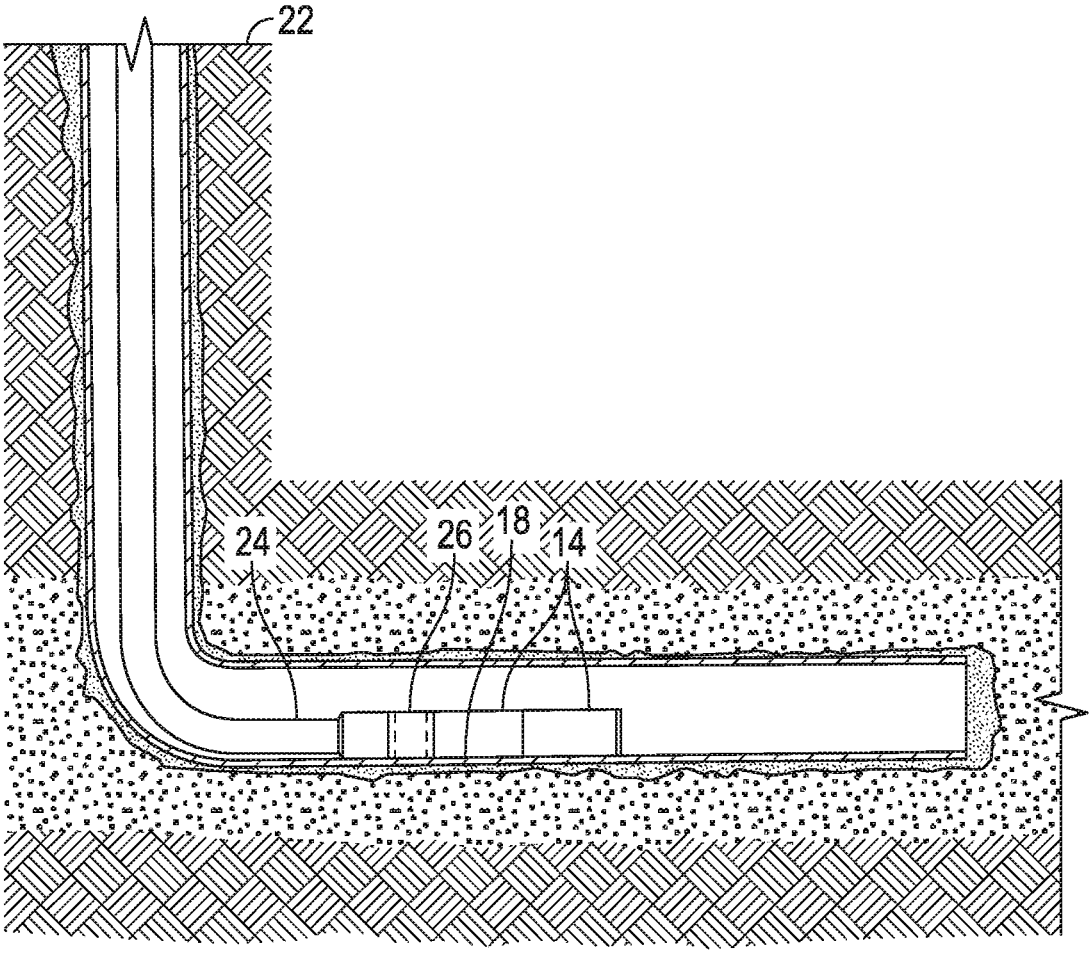
FIG. 3 illustrates a perforating gun having a swiveling loading tube, in accordance with various embodiments of the present disclosure.

An embodiment of the present disclosure having scallops 18 is illustrated in FIG. 3. As shown, the gun carrier 14 is lowered into the well 22 by the work string 24. A swivel 26, such as a radial bearing, is provided within the gun carrier 14 to enable the loading tube 12 to rotate as necessary. If needed, one or more weights may be affixed to the lower end of the carrier 14 and/or the loading tube 12 to cause the carrier 14 to rotate such that the scallops 18, and their associated shaped charges 10, are facing downward. The swivel 26 is configured to allow the free rotation of the internal loading tube 12 based on the center of gravity of the loading tube 12. As discussed above, in embodiments of the present disclosure in which the center of gravity of the loading tube 12 is such that the loading tube 12 will rotate under its own weight to the proper orientation, the addition of weights is not necessary. Further, for a gun carrier 14 that does not have scallops 18, the methodology described herein is equally applicable and the shaped charges 10 are oriented in a downward direction without concern for alignment with the scallops 18.

Figure 4:
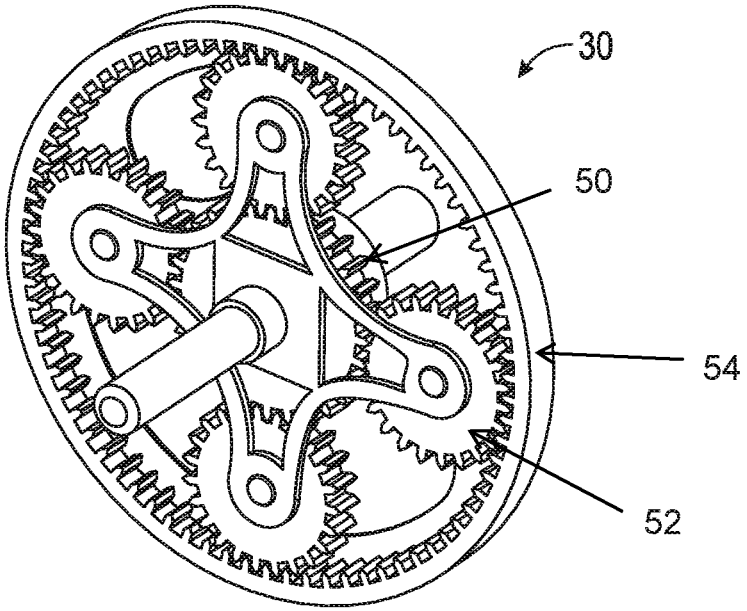
FIG. 4 illustrates a satellite planetary gear mechanism, in accordance with various embodiments of the present disclosure.

In another embodiment of the present disclosure, the swivel 26 may comprise a satellite planetary gear mechanism 30, such as shown in FIG. 4. The planetary gear, as known in the art, comprises a sun gear 50, a planet gears 52, and a ring gear 54. The swivel 26 with the planetary gear 30 is adapted to enable rotation of the internal loading tube 12. As will be discussed herein, combining the swivel 26 and planetary gear 30 with a mechanical/hydraulic or electrical actuating device, enables the orientation of the shaped charges 10 to be accurately controlled.

Figure 5:
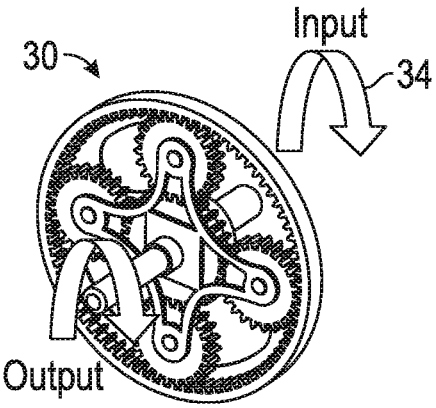
FIG. 5 illustrates an embodiment of the present disclosure in which the loading tube is supported at opposing ends by planetary gears.
Figure 5:
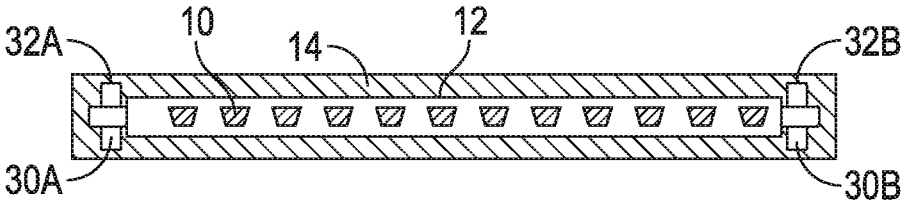

An embodiment of the present disclosure having planetary gears 30 is shown in FIG. 5. As shown, there is a planetary gear 30A housed within a gear box 32A supporting one end of the loading tube 10 and a second planetary gear 30B housed within a gear box 32B supporting the opposite end of the loading tube 10. It should be understood that in other embodiments, one or more additional planetary gears 30 and gear boxes 32 can be provided as additional support at locations along the loading tube 12 between the gear boxes 32A, 32B. Providing a rotational input 34 (illustrated as an arrow) to the planetary gears 30A, 30B, results in the loading tube 12 rotating within the gun carrier 14 to the desired orientation of the shaped charges 10. As will be further described below, the rotational input 34 can result from gravity, with or without added weights, or from a mechanical/hydraulic or electrical actuating device.

Figure 6:
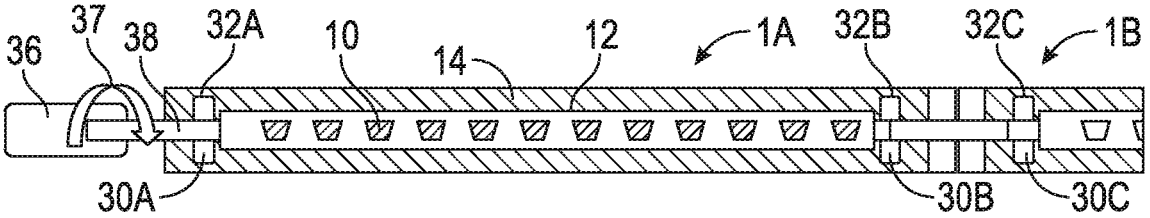
FIG. 6 illustrates an embodiment of the present disclosure having multiple perforating guns connected within a gun string.

FIG. 6 illustrates an embodiment of the present disclosure having multiple perforating guns 1A, 1B connected within a gun string. The lower perforating gun 1B is only partially shown in FIG. 6 but has similar features to the upper perforating gun 1A. Specifically, the perforating guns 1A,1B each having shaped charges 10 carried by a loading tube 12 housed within a gun carrier 14. Gear boxes 32A, 32B, 32C located at the ends of the respective perforating guns 1A provide support for the loading tubes 12 and house the gears that allow for rotation of the loading tubes 12 within the gun carriers 14. In the embodiment shown, planetary gears 30A, 30B, 30C are housed within the gear boxes 32A, 32B, 32C, however, it should be understood that other gearing mechanisms may be used and remain within the purview of the present disclosure.

The embodiment of the present disclosure illustrated in FIG. 6 further comprises an actuating device (i.e. transmission sub) 36. The actuating device 36 is designed to transmit torque to a control rod 38 that in turn causes a torque 37 (shown as an arrow) or rotational force to be applied to the gear 30A housed within the upper gear box 32A. Rotation of the gear 30A acts to rotate the entire loading tube 12 within the gun carrier 14 in the upper perforating gun 1A. Likewise, the rotational force 37 is transmitted to the lower perforating gun 1B, through the action of the additional gears 30B, 30C. In this manner, the actuating device 36 can be used to precisely control the orientation of the shaped charges 10.

In alternate embodiments of the present disclosure in which the orientation of the shaped charges 10 is controlled naturally by gravity, the actuating device 36 illustrated in FIG. 6 may be disengaged such that it does not transmit forces 37 to gear 30A and does not resist or impede rotation of gear 30A. In this manner, the rotation of gear 30A, and thus the loading tubes 12, may occur naturally due to gravitational forces. In still other embodiments in which the orientation of the shaped charges is controlled naturally by gravity, it may not be necessary to provide the actuating device 36.

FIGS. 7A-7E, illustrate an embodiment of the present disclosure comprising planetary gears 30 enabling natural, by gravity, orientation of the loading tube 12. In this embodiment, the gears 30 are self-orienting through the use of weights, such as tungsten.

Figure 7A:
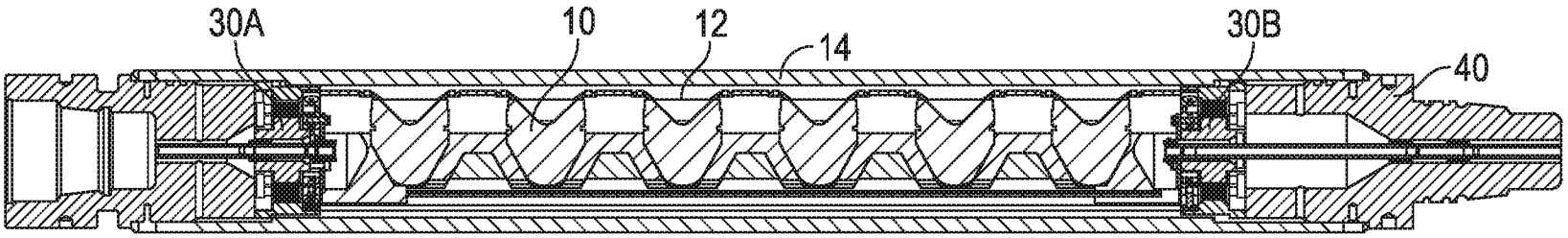
FIGS. 7A-7E illustrate an embodiment of the present disclosure comprising planetary gears.

FIG. 7A shows a cross-sectional view of the internal rotating loading tube 12 housed within the gun carrier 14. The loading tube 12 is rotatable through the use of planetary gears 30A, 30B, located at opposing ends of the loading tube 12. Adapter 40 enables additional perforating guns to be carried within the gun string. In other embodiments of the present disclosure, the gun adapter 40 can be replaced by longer sealed ballstic transfer with trigger charge adapter, which fits for iron rough neck (IRN) operation without human intervention.

Figure 7B:
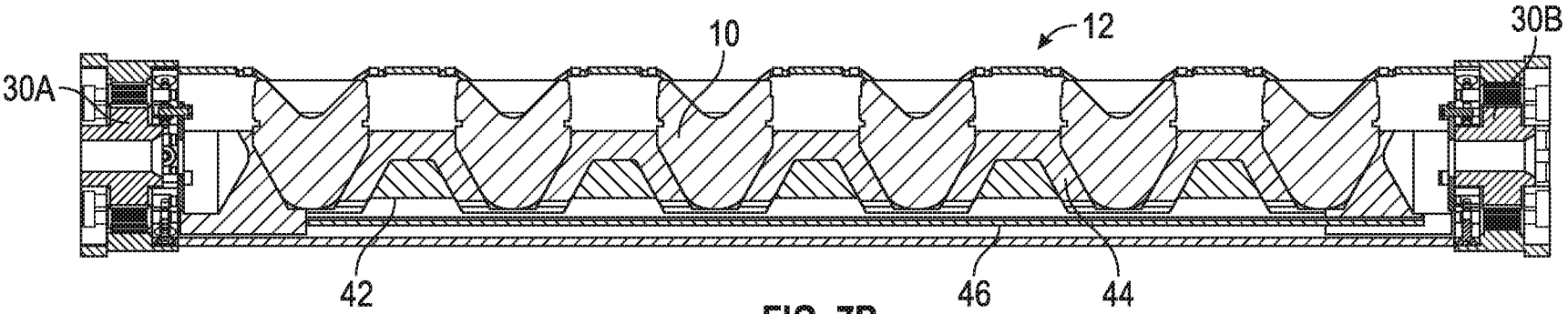
Figure 7C:
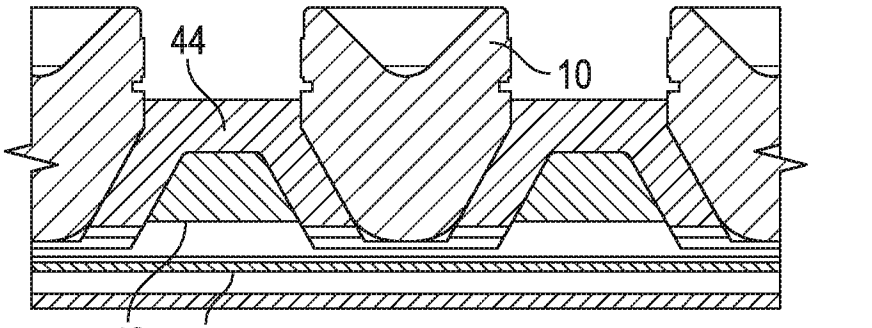

FIG. 7B shows a cross-sectional view of the internal rotating loading tube 12, and FIG. 7C provides a more detailed view of the loading tube 12 of FIG. 7B. As shown, weights 42 are housed between a retainer frame 44 and a retainer plate 46. As discussed previously, the weights are sized and shaped to provide alter the center of gravity of the loading tube 12 such that it rotate to the proper orientation. The charges 10 shown are dummy charges with zero degree phasing.

Figure 7D:
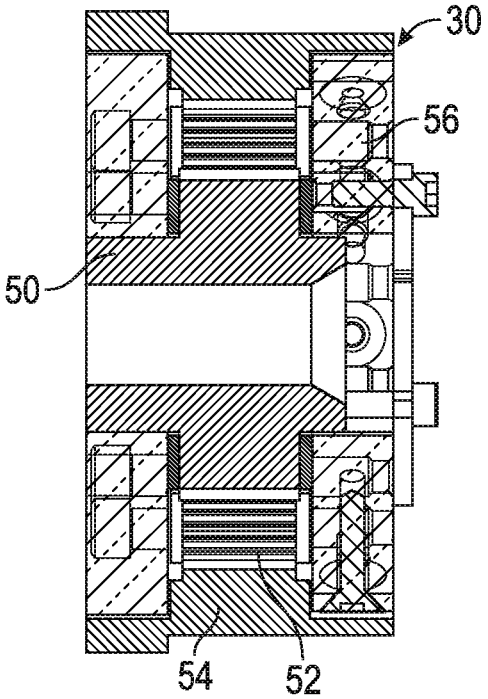
Figure 7E:
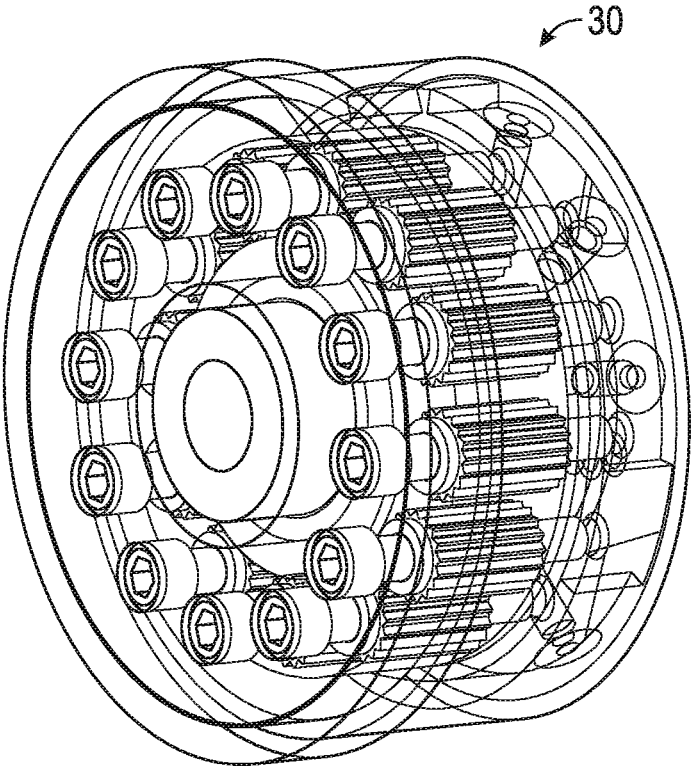

FIGS. 7D-7E show cross-sectional and perspective views of an embodiment of the planetary gears 30 of the embodiment of the present disclosure of FIGS. 7A-7E. As shown, the planetary gears 30 have a sun gear 50, a planet gear 52, and a ring gear 54. For attachment to the loading tube 12, the planetary gear 30 further comprises a loading tube support disk 56.

Figure 8:
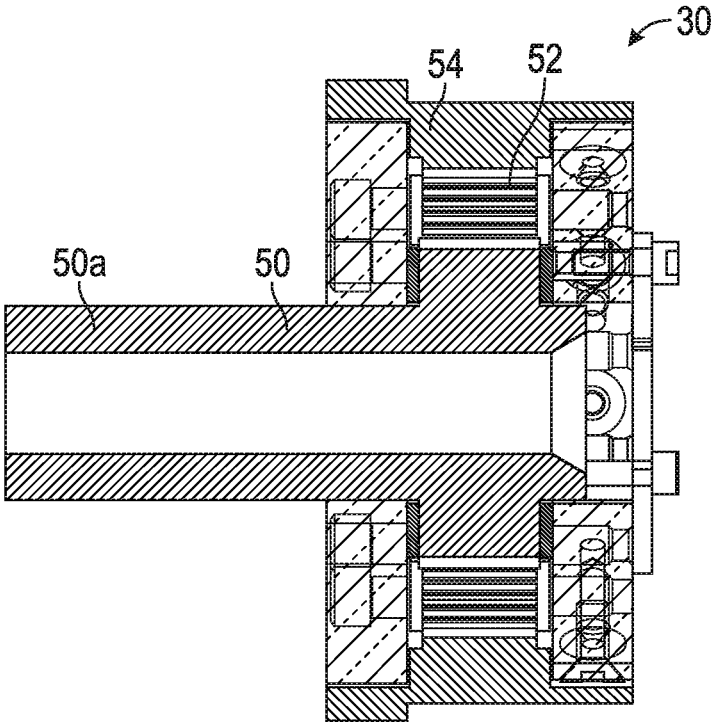
FIG. 8 illustrates an embodiment of the planetary gear of the present disclosure for use with an actuating device, in accordance with various embodiments of the present disclosure.

FIG. 8 illustrates an embodiment of the planetary gear 30 for use in embodiments of the present invention that further include an actuation device. In this embodiment, the collar 50*a* of the sun gear 50 is provided with a longer dimension such that it can be connected to, and oriented by, an actuation device (not shown), such as an electric, mechanical, or hydraulic motor. In this embodiment, the actuating device controls the orientation of the loading tube 12. In this manner, the loading tube 12 can be rotated to the appropriate orientation and maintained in the appropriate orientation by controlling the actuation device.

It should be understood that in embodiments of the present disclosure in which the loading tube 12 is mounted within planetary gears 30, it is not necessary for the loading tube 12 to be mounted approximate the longitudinal centerline of the gun carrier 14. Embodiments of the present disclosure using planetary gears 30 in which the loading tubes 12 are mounted such that they are offset from the longitudinal centerline of the gun carrier 14 remain within the purview of the present disclosure.

Figure 9A:
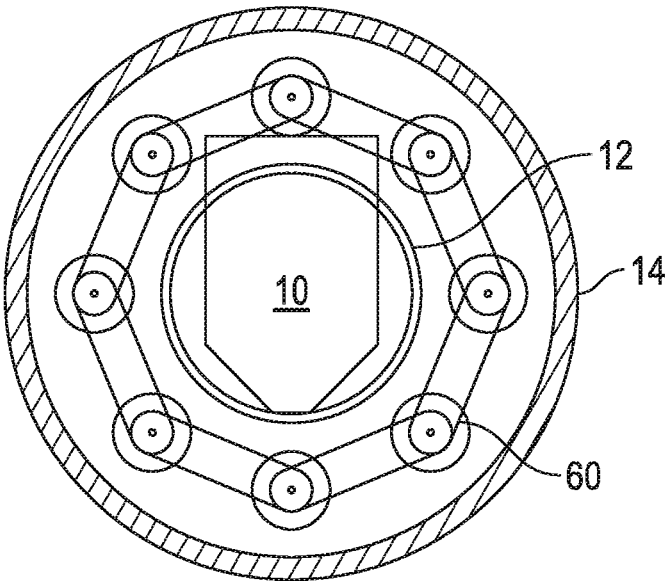
FIG. 9A and FIG. 9B show another embodiment of the present disclosure having a roller chain adapted to engage the loading tube.
Figure 9B:
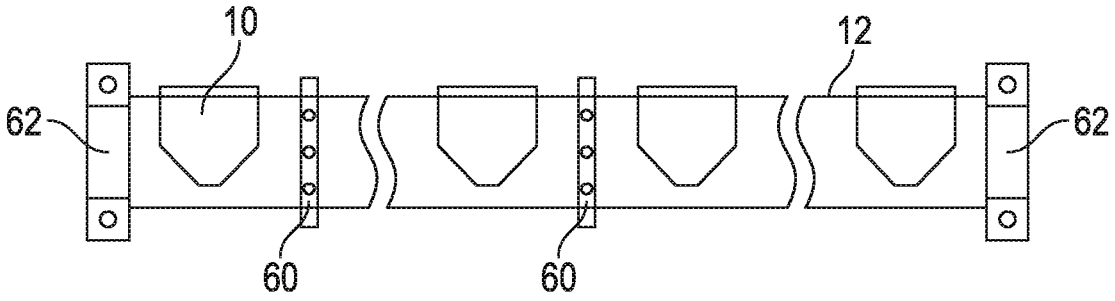

FIGS. 9A and 9B show another embodiment of the present disclosure in which a roller chain 60 is used to orient the loading tube 12 carrying the shaped charges 10. As best seen in FIG. 9A, the roller chain 60 is connected head to tail to construct an enclosed ring. The roller chain 60 is wrapped around the loading tube 12 to enable rotation of the loading tube 12 and thus orientation of the shaped charges 10. The roller chain 60 should be made of steel or other materials of sufficient strength to enable rotation of the loading tube 12 when engaged.

As shown in FIG. 9B, the loading tube 12 in the illustrated embodiment of the present disclosure has bearing supports 62 at opposing ends of the loading tube 12. The bearing supports 62 allow for rotation of the loading tube 12 upon action of the roller chain 60. In the illustrated embodiment, there are two (2) roller chains 60 provided. It should be understood, however, that any number of roller chains 60 may be used and remain within the purview of the invention. The location and spacing of the roller chains 60 is preselected and may be based upon the specific application. Each roller chain 60 may be positioned between any two (2)

shaped charges 10. In embodiments of the present disclosure, the loading tube 12 may be designed with pre-cut bendable tabs, such that pairs of tabs with a distance between to fit a chain 60 width will be bent to constrain the axial movement of the chain 60.

Figure 10:
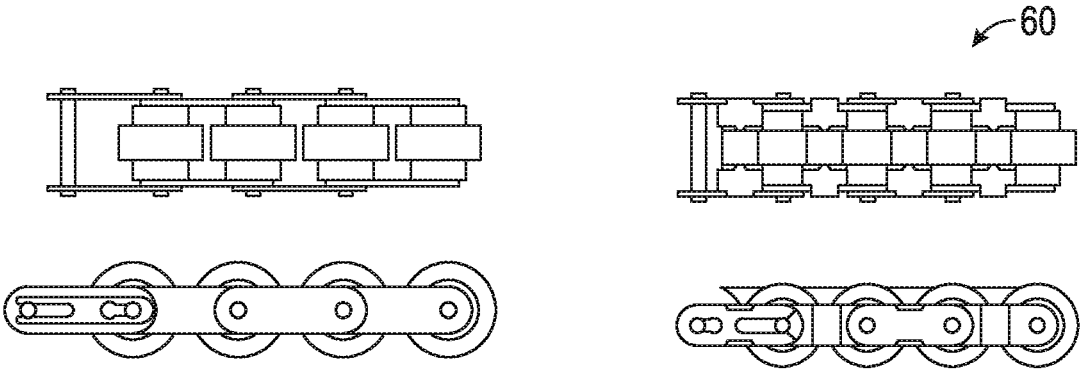
FIG. 10 illustrates an embodiment of the roller chain engaging the loading tube, in accordance with various embodiments of the present disclosure.
Figure 11:
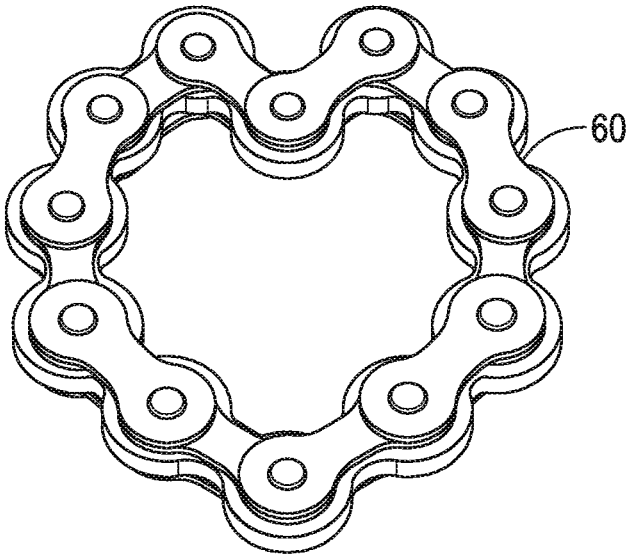
FIG. 11 illustrates an embodiment of the roller chain of the present disclosure with its ends connected head to tail.

The roller chain 60 may be an off-the-shelf product, examples of which are shown in FIG. 10. The roller chain 60 may be cut to the proper length based on the outer diameter (OD) of loading tube 12 and the ends of the chain 60 can be connected head to tail as shown in FIG. 11. In embodiments of the present disclosure, the chain 60 should not tighten around the loading tube 12 such that it impedes rotation of the loading tube 12. This particularly true when desiring to orient the loading tube 12 naturally under gravity.

It should be understood that in embodiments of the present disclosure in which the loading tube 12 is rotated through use of a roller chain 60, it is not necessary for the loading tube 12 to be mounted approximate the longitudinal centerline of the gun carrier 14. Embodiments of the present disclosure using a roller chain 60 in which the loading tube 12 is mounted such that it is offset from the longitudinal centerline of the gun carrier 14 remain within the purview of the present disclosure.

Figure 12:
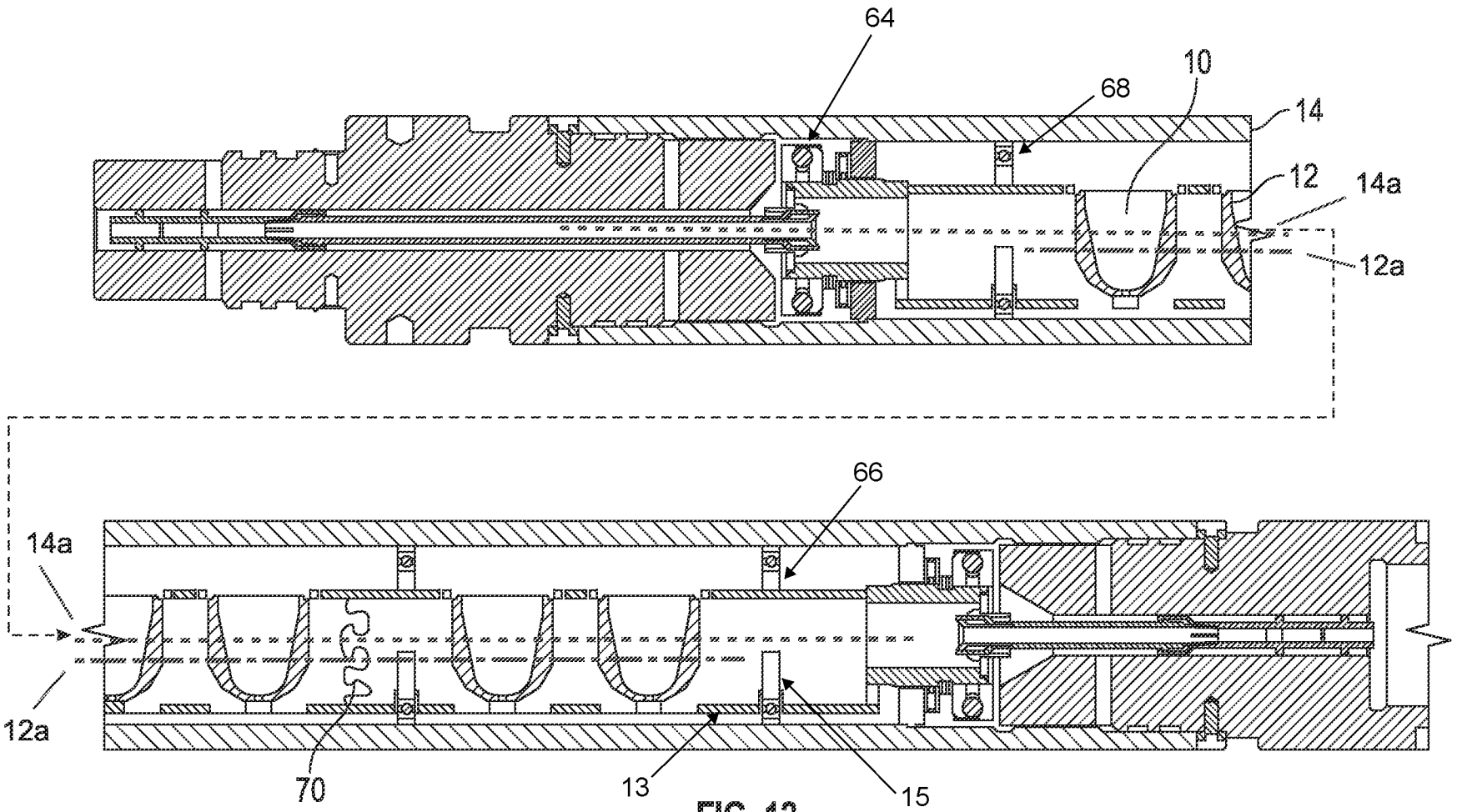
FIG. 12 shows embodiment of the present disclosure in which the longitudinal centerline of the loading tube is offset from the longitudinal centerline of the carrier.

Another embodiment of the present disclosure is shown in FIG. 12. As shown, in this embodiment, the loading tube 12 is offset from the center of the gun carrier 14. The loading tube 12 is mounted on radial bearings 68 such that the longitudinal centerline 12*a* of the loading tube 12 is offset from the longitudinal centerline 14*a* of the gun carrier 14. The offset allows the eccentric weight of the loading tube 12 to assist in orienting the shape charges 10. In this embodiment, the weight of the shaped charges 10 themselves also become orienting weights due to the offset. The radial bearings 68 may be disposed, at least partially, in an aperture 15 in a sidewall 13 of the loading tube 12. The radial bearings 68 may be mounted on a spacer 66. The spacer 66 may be an offset spacer.

An offset mount at each end of the loading tube 12 has thrust bearings 64 that assist in reducing friction and help locate the ballistic transfer in the proper position for reliable performance.

It should be understood that although the offset loading tube 12 shown in FIG. 12 is mounted on radial bearings 68, in alternate embodiments of the present disclosure, the offset loading tube 12 can be mounted on planetary gears as described herein with reference to FIGS. 4-8.

In some embodiments of the present disclosure illustrated in FIG. 12, there may also be provided "puzzle cuts" 70 in the loading tube 12 that allow some articulation of the loading tube 12, during conveyance. The articulation prevents or minimizes orientation of the shaped charges 10 to the bend direction in bent wellbore sections.

Figure 13:
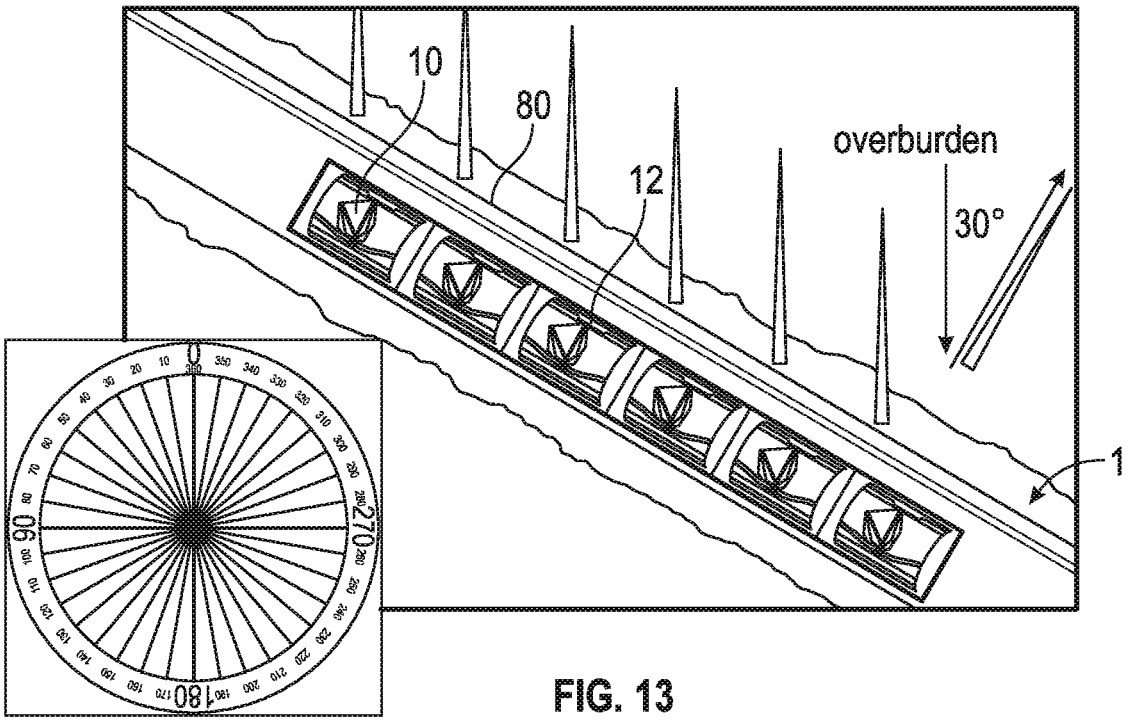
FIG. 13 illustrates an embodiment of the present disclosure deployed in a deviated well.

In some embodiments, such as illustrated in FIG. 13, it may be necessary for the shaped charges 10 to be tilted or angled relative to the perpendicular of the longitudinal axis of the loading tube 12. For example, when using the perforating gun 1 of the present invention in deviated wellbores 80, it may be desired to angle the shaped charges 10 relative to the longitudinal axis of the perforating gun 1 to shoot in the direction of maximum stress. This is suited for sand prevention perforating, for example.

A large proportion of wells are drilled at high angle to reduce drilling complications as well as improve accessibility of the well by wireline for intervention (sand bailing/isolation). For this reason, many of these wells are drilled between 40° to 60° deviation. As shown in FIG. 13, for perforating gun systems 1 deployed by wireline or TCP for sand prevention, even with ideal orientation, the angle of the shaped charges 10 can be over 30° from optimal, with this deviation widening if the orientation accuracy is impaired.

Some field results indicate sanding from wireline deployed orientated systems in the 40° to 60° deviated wells is factored into future decision-making processes directed towards open hole screens, gravel packs and standard phased guns.

Figure 14A:
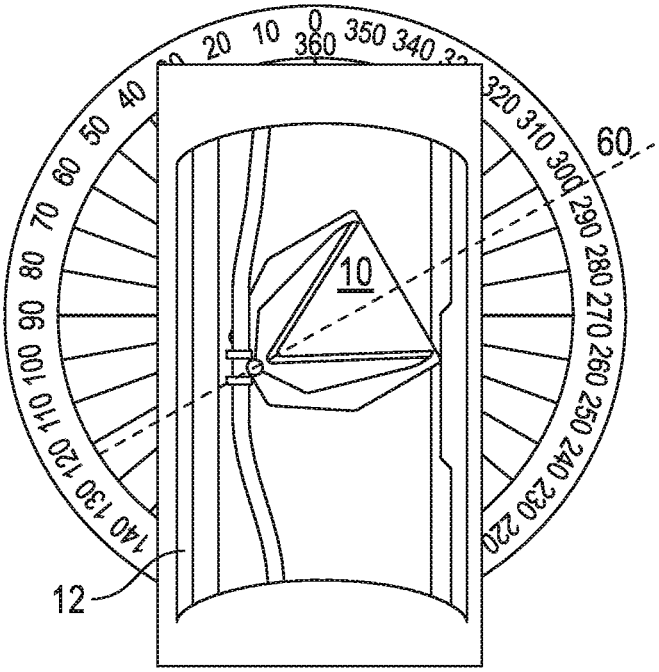
FIGS. 14A-14C illustrate the angled shaped charges of the present disclosure in deviated wellbores.
Figure 14B:
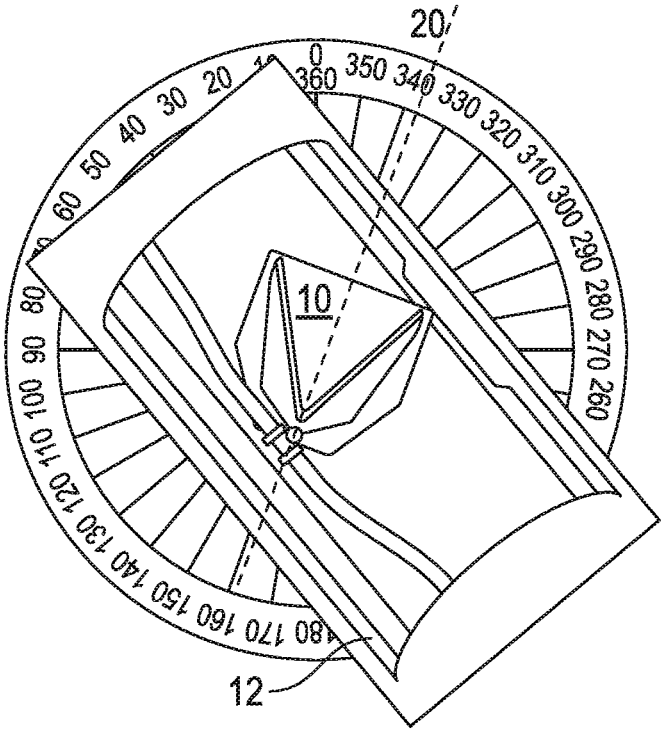
Figure 14C:
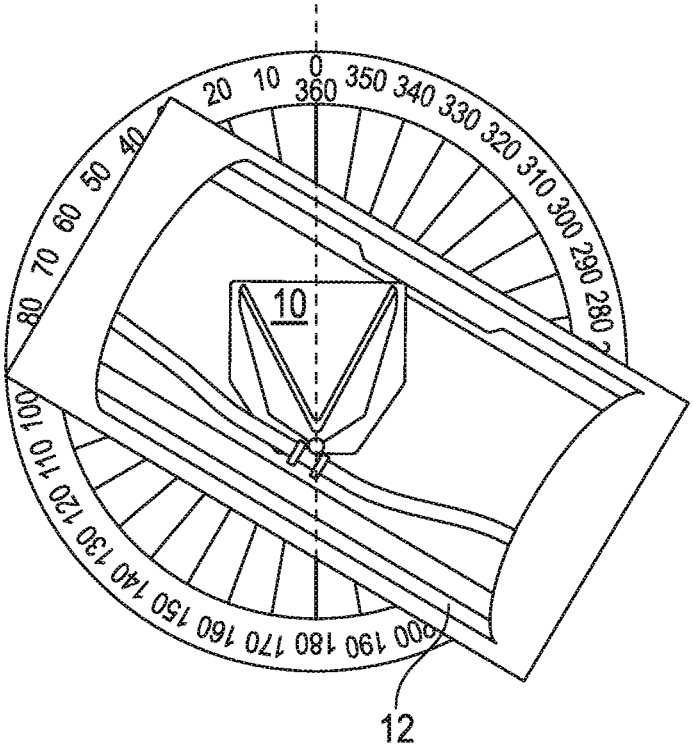

FIGS. 14A-14C illustrate the angled shaped charges 10 of the present invention in a vertical well (FIG. 14A), a 40-degree deviated well (FIG. 14B) and a 60-degree deviated well (FIG. 14C). The shaped charges 10 are angled relative to the longitudinal axis of the loading tube 12. The optimum angle of the shaped charges 10 can be rigidly fixed, achieved by weighting the shaped charges, oriented by an actuating device such as has been described herein, or can be oriented by conventional means. The optimum angle of the shaped charges 10 is based on the direction of maximum stress for the deviated wellbore 80.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded. In the claims, means-plus-function clauses are intended to cover the structures described herein as performing the recited function and not only structural equivalents, but also equivalent structures. It is the express intention of the applicant not to invoke 35 U.S.C. § 112, paragraph 6 for any limitations of any of the claims herein, except for those in which the claim expressly uses the words "means for" together with an associated function.

What is claimed is:

1. A perforating assembly comprising:

a gun carrier having a longitudinal centerline;

a loading tube having a longitudinal centerline, the loading tube mounted within the gun carrier using an offset mount at each end of the loading tube such that the longitudinal centerline of the loading tube is offset from the longitudinal centerline of the gun carrier, and each offset mount comprising a thrust bearing; and a plurality of shaped charges within the loading tube; and wherein the loading tube is mounted within the gun carrier on one or more swivel mechanisms that enable the loading tube to rotate within the gun carrier, the one or more swivel mechanisms comprising a radial bearing at least partially disposed in an aperture in a sidewall of the loading tube.

2. The perforating assembly of claim 1 wherein the loading tube rotates based on the center of gravity of the loading tube and the plurality of shaped charges.

3. The perforating assembly of claim 1 further comprising weights affixed to the loading tube to alter the center of gravity of the loading tube.

4. The perforating assembly of claim 3, wherein the weights are housed within a frame within the loading tube.

5. The perforating assembly of claim 1 wherein the plurality of shaped charges are angled relative to the longitudinal axis of the loading tube.

6. The perforating assembly of claim 1, comprising a plurality of gun carriers and a plurality of loading tubes.

7. The perforating assembly of claim 1, wherein the loading tube further comprises puzzle cuts.

8. A method of orienting a loading tube having a longitudinal centerline within a perforating gun carrier having a longitudinal centerline, the loading tube having shaped charges mounted therein, the method comprising:

mounting the loading tube on a swiveling device comprising a radial bearing within the perforating gun carrier, wherein the radial bearing is at least partially disposed in an aperture in a sidewall of the loading tube, wherein the loading tube is mounted using an offset mount at each end of the loading tube to offset from the longitudinal centerline of the perforating gun carrier, the offset mount comprising a thrust bearing;

conveying the perforating gun carrier downhole; and rotating the loading tube within the gun carrier.

9. The method of claim 8, wherein the swiveling device enables free rotation of the loading tube based on the center of gravity of the loading tube.

10. The method of claim 8, wherein the swiveling device is affixed to an actuation device that controls the orientation of the loading tube.

11. The method of claim 8, further comprising mounting the shaped charges at one or more angles relative to the longitudinal centerline of the loading tube.

12. The perforating assembly of claim 8, wherein the loading tube further comprises puzzle cuts.

13. A perforating assembly comprising:

a first gun carrier coupled to a second gun carrier, each of the first and second gun carriers having a longitudinal centerline;

a loading tube in each of the first and second gun carriers, each loading tube having a longitudinal centerline, the loading tube mounted within the respective gun carrier using an offset mount at each end of the loading tube such that the longitudinal centerline of the loading tube is offset from the longitudinal centerline of the respective gun carrier, each offset mount comprising a thrust bearing; and a plurality of shaped charges within each loading tube;

wherein each loading tube is mounted within the respective gun carrier on one or more swivel mechanisms that enable the loading tube to rotate within the gun carrier, the one or more swivel mechanisms comprising a radial bearing at least partially disposed in an aperture in a sidewall of the loading tube.

14. The perforating assembly of claim 13, wherein the shaped charges of each loading tube are angled relative to the longitudinal axis of the respective loading tube.

15. The perforating assembly of claim 13, wherein each shaped charge is housed in a frame.

16. The perforating assembly of claim 13, wherein the thrust bearing helps locate a ballistic transfer between the loading tubes of the first and second gun carriers.

17. The perforating assembly of claim 13, wherein the loading tube further comprises puzzle cuts.

* * * * *